United States Patent [19]

Cox

[11] Patent Number: 5,029,553

[45] Date of Patent: Jul. 9, 1991

[54] APPARATUS FOR PROVIDING A UNIFORM COATING ON A CONTINUOUS HORIZONTALLY MOVING METAL STRIP

[75] Inventor: Gary H. Cox, Sanford, N.C.

[73] Assignee: Trion, Inc., Sanford, N.C.

[21] Appl. No.: 326,452

[22] Filed: Mar. 20, 1989

Related U.S. Application Data

[63] Continuation of Ser. No. 330,001, Dec. 11, 1981, abandoned.

[51] Int. Cl.[5] ..... B05C 11/00

[52] U.S. Cl. ..... 118/674; 118/627; 118/630; 118/638

[58] Field of Search ..... 427/32; 118/629, 630, 118/627, 638, 674; 239/708

[56] References Cited

U.S. PATENT DOCUMENTS

| | | | |
|---|---|---|---|
| 2,551,035 | 5/1951 | Miller | 118/630 X |
| 2,595,342 | 5/1952 | Dosmann | 118/630 X |
| 2,669,941 | 2/1954 | Stafford | 417/125 |
| 2,762,331 | 9/1956 | Henderson | 118/325 X |
| 2,794,417 | 6/1957 | Starkey et al. | 118/51 |
| 2,796,845 | 6/1957 | Rendel | 118/634 |
| 2,888,362 | 5/1959 | Starkey | 118/630 X |
| 2,994,618 | 8/1961 | Landgraf . | |
| 3,169,883 | 2/1965 | Juvinall | 239/708 X |
| 3,301,699 | 1/1967 | Mozzi | 118/315 X |
| 3,382,845 | 5/1968 | Jester | 118/610 |
| 3,452,710 | 7/1969 | Hentschel | 118/674 |
| 3,726,701 | 4/1973 | Nishikawa et al. . | |
| 4,020,792 | 5/1977 | Jordan | 118/629 |
| 4,073,966 | 2/1978 | Scholes et al. | 427/26 |
| 4,132,189 | 1/1979 | Greve et al. | 118/674 |

OTHER PUBLICATIONS

Kirk-Othmer Encyclopedia of Chemical Technology; Third Edition; volume 21, p. 466; vol. 6, pp. 414–418; 1983.

Latimer et al., "Application of an Electrostatic Oiler to a Continuous Pickling Line" from *Iron & Steel Engineer*, Jun. 1981.

*Primary Examiner*—Shrive Beck
*Assistant Examiner*—Alain Bashore
*Attorney, Agent, or Firm*—Burns, Doane, Swecker & Mathis

[57] ABSTRACT

An apparatus for providing a uniform application of a functional coating to one or both sides of a moving metal strip includes an enclosed cabinet in which a corona discharge field is established between high voltage electrodes and the strip. The coating liquid and air are separately supplied under pressure to atomizing nozzles within the enclosure. The nozzles create a dense flat spray that is directed into the discharge field at an acute angle relative to the strip. The particles in the spray become charged and are attracted to the grounded strip, while those that are not charged are directed onto the strip by the force of the discharge field. The rate at which the coating liquid is supplied to the nozzles is varied in accordance with the speed of the strip to thereby obtain a uniform coating regardless of variations in strip speed or width.

22 Claims, 4 Drawing Sheets

APPARATUS FOR PROVIDING A UNIFORM COATING ON A CONTINUOUS HORIZONTALLY MOVING METAL STRIP

This application is a continuation, of application Ser. No. 330,001 filed Dec. 11, 1981, now abandoned.

BACKGROUND OF THE INVENTION

The present invention relates to the application of liquid coatings to continuously moving objects, and more particularly to the non-contact deposition of functional coatings to a metal strip moving along a horizontal process line.

One type of device for automatically coating a moving metal strip with a fluid such as oil is disclosed in U.S. Pat. No. 2,994,618 issued to G. F. Landgraf. The device disclosed in this patent is primarily designed to apply micro-thin films of oil to light gauge container materials. For example, it can be used to apply lubricants on electrolytic tinning lines, chrome lines and recoil lines. The lubricant is applied to the metal strip as it is moving in a vertical direction, which may require a change in direction of the metal but is easily provided for in a line of light gauge material. Typically, in depositing operations in which the Landgraf device is used, the metal strip moves at a speed in the range of 400–2000 feet per minute, and the coating weight of the lubricant is in the range of 0.2–1.2 mg/ft$^2$ per side.

The Landgraf device has met with considerable success in the field of depositing oil coatings to light gauge metals, and it is desirable to provide an apparatus that is capable of achieving similar results in process lines for heavier and thicker materials, such as in various steel strip treatment and forming applications.

There are a variety of reasons for applying functional types of coatings to steel strips. One of the most significant of these reasons is for corrosion protection. Surface oxidation or corrosion that occurs prior to the time the strip product reaches its final destination, or while it is in storage for fabrication, can result in substantial losses, and it is therefore necessary to protect against such diminishing of the product quality.

Furthermore, during high production metal forming and fabrication operations, such as cold rolling, surface lubrication of the metal is critical. The preciseness of the operations requires close control of the amount and type of lubricant that is applied. For example, too small an amount of lubricant can result in excessive friction wear on tools and production equipment. Conversely, too much lubricant has an adverse effect on the metal forming equipment, such as clogging dies and tools. It also inhibits subsequent chemical cleaning of the metal strip, and makes handling of the product difficult.

In addition, it is desirable to apply functional coatings to steel strips for surface pretreatment and cosmetic reasons.

In the past, coatings have been typically applied to steel strips by means of a distribution pipe disposed over the moving strip. The pipe has holes in it which allow the coating material to drip onto the strip, and cloth wiper rolls are used to meter the amount of oil that remains on the strip. Mechanical spray nozzles have also been used to apply coatings. Disadvantages associated with these techniques include the waste of coating material that results, the environmental and safety problems that are generated when excess coating material is released into the working environment, and the unpredictability and nonuniformity of the coating that is applied. In addition, they may be limited to applying the coating to one side of the strip, and they may not be adjustable for varying strip widths.

An alternative to the use of spray or drip type coating has been to apply the liquid by an electrostatic process in which the material to be applied is electrically charged. However, most electrostatic coaters that are used in continuous process lines are adapted to apply only non-conductive types of coatings, such as petroleum based oils and organic lubricants. Recently, a number of conductive materials having preferred functional characteristics have been developed. For example, aqueous based vapor phase rust inhibitors have become popular, and it is desirable to apply these through an electrostatic process.

The previously described Landgraf device, while well suited to the non-contact coating of light metals, is not readily applicable to the steel strip process. For example, it is most desirable to provide a strip coating device in a horizontal section of the steel process line, whereas the Landgraf device is designed for operation in a vertical pass section. It is not generally desirable to change the direction of heavy gauge steel strip, as opposed to light gauge metals. Furthermore, and perhaps more significantly, the typical coat weights that are required in steel processing lines (e.g. 50–400 mg/ft$^2$ per side) are substantially greater than those encountered in light gauge metal processing. The uniform application of such coat weights at line speeds that can vary between 50–5000 ft/min pose a requirement for a different type of fluid application system than that used in light gauge systems. In other words, it is not simply a matter of increasing the operating parameters of the system to obtain the desired coat weights and still achieve the desired objects.

OBJECTS OF THE INVENTION

Accordingly, it is a general object of the present invention to provide a novel apparatus for applying functional coatings to a moving metal strip in a continuous pass process.

It is another object of the present invention to provide such an apparatus that is capable of uniformly applying functional coatings to each side of a horizontally moving strip at coat weights in the range of 50–400 mg/ft$^2$.

It is a further object of the present invention to provide such an apparatus that utilizes an electrostatic force field to: (a) direct a spray of atomized particles into contact with the strip; (b) induce an electrostatic charge on the particles and thereby enable both conductive and non-conductive coatings to be applied.

It is yet another object of the present invention to provide such an apparatus that can accommodate varying strip widths.

It is still a further object of the present invention to provide such an apparatus that reduces waste of coating materials, thereby realizing a lower net cost of the coating operation and safer environmental conditions.

It is yet a further object of the present invention to provide a novel fluid coating device that can be readily retrofitted into an existing horizontal pass steel strip processing line.

The manner in which the present invention achieves the foregoing objects and advantages can best be understood from the following detailed description of the preferred embodiment illustrated in the accompanying drawings.

DETAILED DESCRIPTION

In the following description of the preferred embodiment of the invention, it is described with exemplary reference to its use in coating a moving steel strip. It will be appreciated, however, that the applicability of the invention is not so limited, but rather that it can be successfully employed in any situation requiring a substantially heavy coating of either a conductive of a non-conductive liquid on a moving strip.

Figure 1:
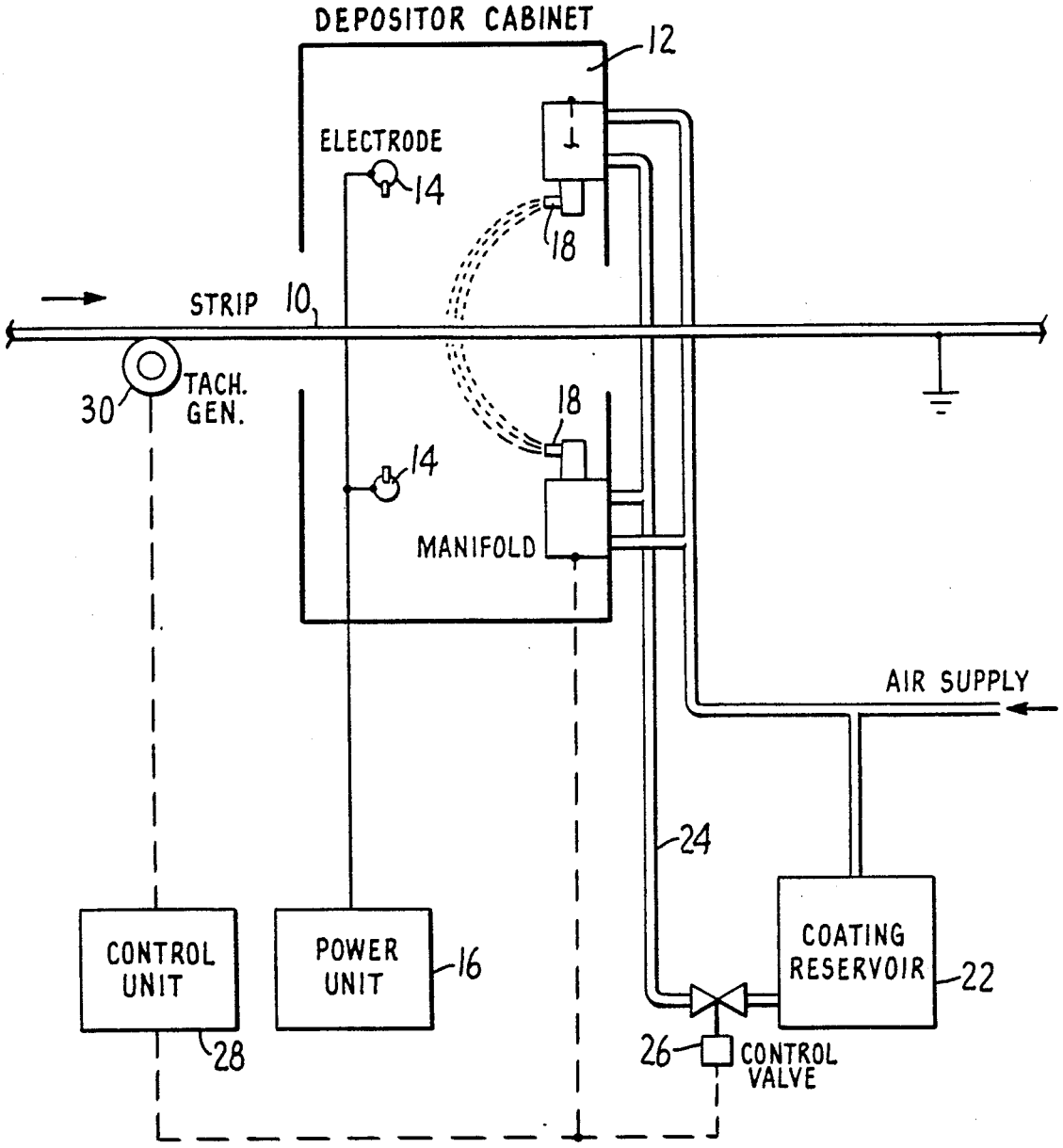
FIG. 1 is a schematic block representation of the major components of the preferred embodiment of the invention.

Referring to the general illustration of the strip coating apparatus in FIG. 1, a horizontally moving steel strip 10 passes through a deposition cabinet 12 disposed in a processing line, such as a pickling line for example. The strip is held at a ground potential, as schematically illustrated in the Figure. The grounding of the strip can be accomplished, for example, by maintaining one or more of the drive rollers (not shown) that contact the strip at a ground potential.

Within the deposition cabinet 12, a corona discharge field is established between the strip and a pair of high voltage electrodes 14 respectively disposed on either side of the strip. The electrodes are maintained at a high voltage, e.g. up to 100 KV D.C. depending on the coating to be applied, by means of power supplied from a suitable power unit 16. An atomized spray of finely divided particles of the liquid to be coated is directed into the corona discharge field by means of a series of atomizing nozzles 18. As the particles of liquid enter the corona discharge field, a number of them become electrically charged and are electrostatically attracted to the grounded strip 10. In addition, the force field that is established by the corona discharge deflects any particles of the liquid that are not electrostatically charged onto the strip as well. In this manner, practically all of the liquid particles that are sprayed from the nozzles 18 are deposited on the strip 10 in a uniform, controllable manner.

The coating liquid is distributed among the nozzles 18 by means of a manifold system 20 including a liquid manifold that is connected to a coating reservoir 22. The reservoir 22 includes one or more tanks that are supplied with pressurized air to cause the coating liquid to travel along a suitable supply line 24 to the manifold system. A source of pressurized air (not shown in FIG. 1) is also connected to the nozzles 18 by means of an air manifold, to assist the nozzles in providing the spray of atomized liquid.

The rate at which the coating liquid is sprayed from the nozzles 18 and applied to the strip 10, i.e. the coat weight, is controlled by a control valve 26 deposited within the supply line 24 and connected to a control unit 28. A suitable conventional tachometer/generator 30 senses the speed of the strip 10 and provides a voltage representative of the sensed speed to the control unit. In response to this input signal and a manually entered coat weight signal, the control unit 28 provides an output signal to adjust the control valve 26 to regulate the rate of liquid supply to the nozzle 18 in accordance with strip line speed and desired coat weight. In addition, when the tachometer/generator 30 provides an indication that the strip is not moving, the control unit 28 can send a signal to solenoid operated valves associated with the nozzles 18 to cause them to close and thereby prevent dripping of the coating liquid from the nozzles.

Figure 2:
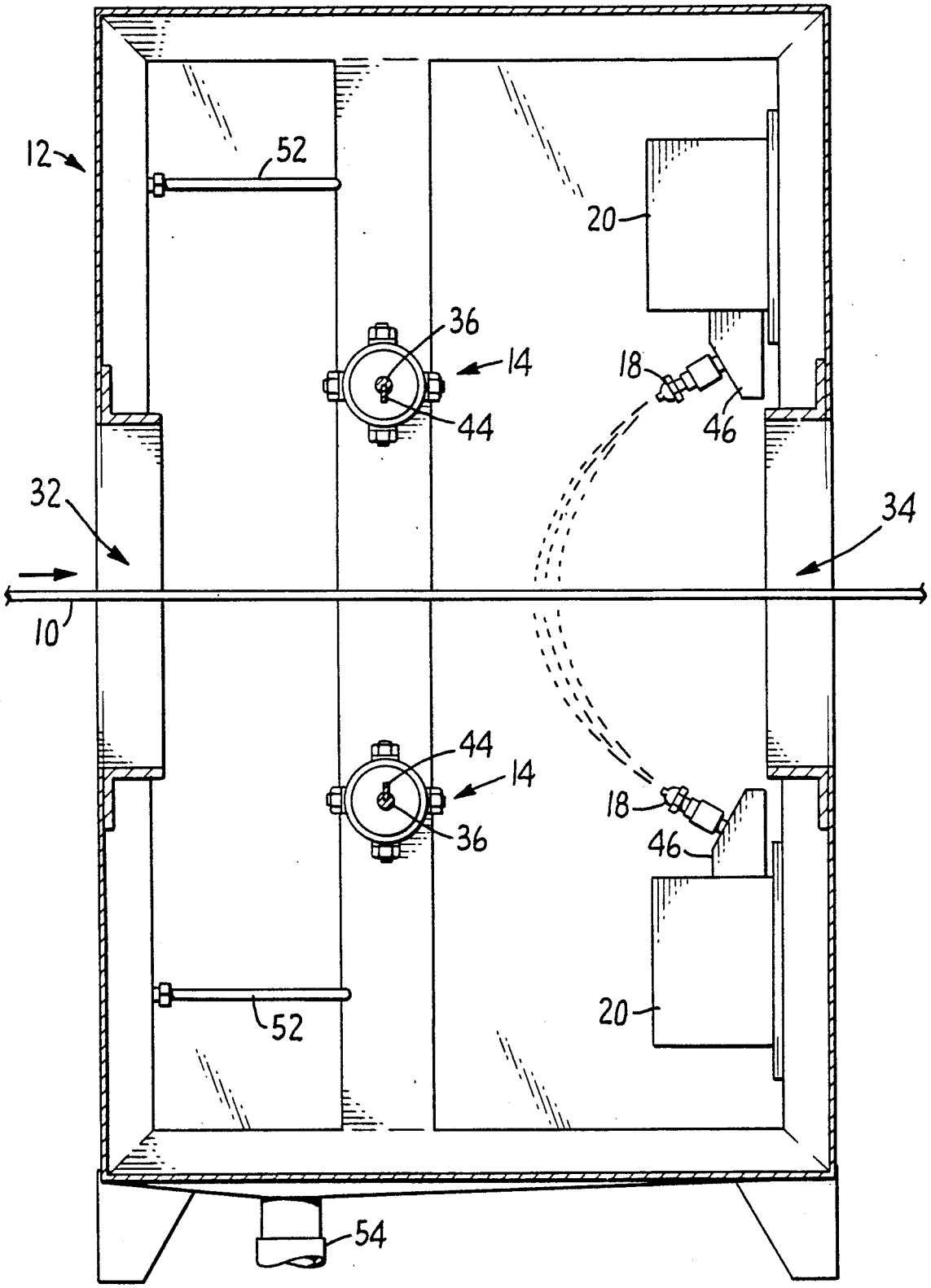
FIG. 2 is a sectional side view of the fluid deposition cabinet.
Figure 3:
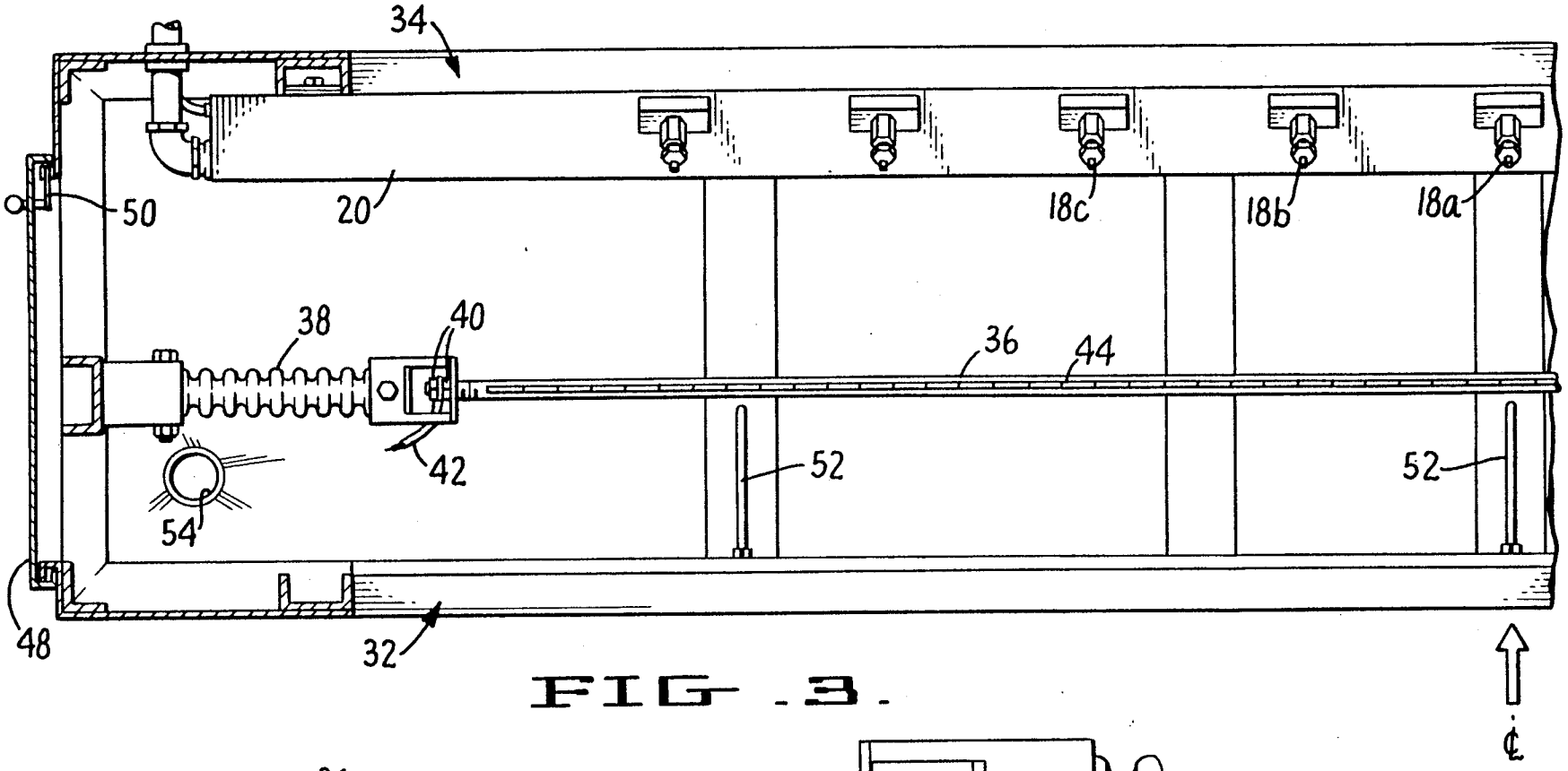
FIG. 3 is a sectional top view of a portion of the fluid deposition cabinet.

The deposition cabinet 12 is illustrated in greater detail in FIGS. 2 and 3. The cabinet is basically a rectangular enclosure having two openings 32 and 34 which enable the strip to enter and exit the interior thereof. The electrodes 14 are provided at suitable distances, e.g. 6 inches, above and below the strip 10 near the center of the enclosure. Each electrode comprises a rod 36 that is threaded at both ends for connection to insulators 38 that support the rods from the side walls of the cabinet 12. Preferably, a suitable tension is maintained on the rods at all times by appropriate adjustment of nuts 40 that secure the rods to the insulators. A high voltage cable 42 is attached to one end of each rod and connects the rods to the power supply unit 16.

Figure 4:
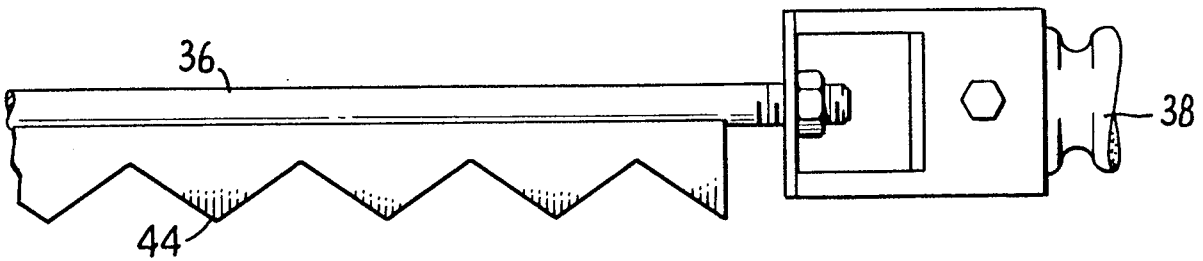
FIG. 4 is a side view of the high-voltage corona discharge electrode.

Each of the rods 36 has a suitable diameter, e.g. ½ inch, and includes a longitudinal slot that opens towards the strip 10. An electrode blade 44 is fitted within the slot. As best illustrated in FIG. 4, the electrode blade 44 has a serrated, or notched edge that faces the strip. It has been found that an electrode blade having teeth of the type illustrated in FIG. 4 provides an efficient corona discharge field between the electrode and the strip 10.

The air atomizing nozzles 18 are disposed downstream of the electrodes 14 in two series extending in a direction transverse to the travel of the strip. One series is located above the strip and the other is disposed below the strip. The nozzles are supported on the manifold units 20 by mean of suitable insulators 46. The nozzles are arranged to spray the coating fluid into the corona discharge field at an acute angle relative to the strip, and this angle is preferably about 30°. The number of nozzles that are arranged across the width of the cabinet 12 and their spacing are determined according to the spray pattern of the nozzles, and the various widths of strips that are expected to be encountered, to provide a uniform spray pattern.

In the illustrated embodiment of the invention, nozzles are provided in a series (five of which are shown in FIG. 3). The nozzles are independently controllable by means of solenoid controlled valves in the connecting lines between the liquid manifold and the nozzles for adjustment of the liquid spray in accordance with the width of the strip being coated. For example, in the preferred embodiment when the strip width is 24", the center nozzle 18*a* and the nozzles 18*b* on each side of the center nozzle are the only nozzles that are actuated. For a 42" wide strip, the nozzles 18*c* on each side of the three central nozzles 18*a* and 18*b* would also be actuated. Successive nozzles are actuated for increasing strip widths, so that a 78" wide strip can be coated when all nine nozzles are operating. In addition, all the nozzles in one series can be closed so that only one side of the strip is coated.

The nozzle output orifices are designed so that a flat spray is directed at the desired angle into the corona discharge field. One particular type of air atomizing nozzle that has been found to be particularly well-suited for operation in the context of the present invention is sold by the Delevan Corporation of West Des Moines, Iowa as part no. 38977-1. This nozzle has a liquid inlet port located on the side of the nozzle, an air inlet port on the rear of the nozzle and a 0.043 inch output orifice.

Each end of the depositor cabinet 12 includes a door 48 that provides access to the interior of the cabinet for normal maintenance, removal of the electrodes, etc. Each door is preferably provided with a suitable safety interlock mechanism 50 that is connected with the high voltage supply unit 16 to interrupt the supply of power to the electrodes whenever the door is unlatched. The safety interlock mechanism can also provide a signal to the control unit 28 to cause the solenoid operated valves for the nozzles to be closed when the access door is opened. The access doors preferably include inspection ports to permit viewing of the coating process while the system is in operation.

A plurality of thermocouples 52 are disposed at suitable locations within the interior of the cabinet 12. These thermocouples form part of a fire warning and control system. If a fire should erupt within the enclosure, the thermocouples provide a signal to an alarm system to shut down the coating system. In addition, a suitable fire extinguishing system, such as a $CO_2$ system (not shown), can be connected to the alarm system to spray a fire extinguish-extinguishing chemical into the enclosure if the alarm condition persists for a predetermined length of time.

The bottom of the cabinet is suitably shaped as a shallow trough and includes a drain opening 54 at the lowest point thereof. The trough and drain enables any coating liquid that is not deposited on the steel strip to be collected and returned to the coating reservoir 22 for recycling into the system.

Figures 5, 6:
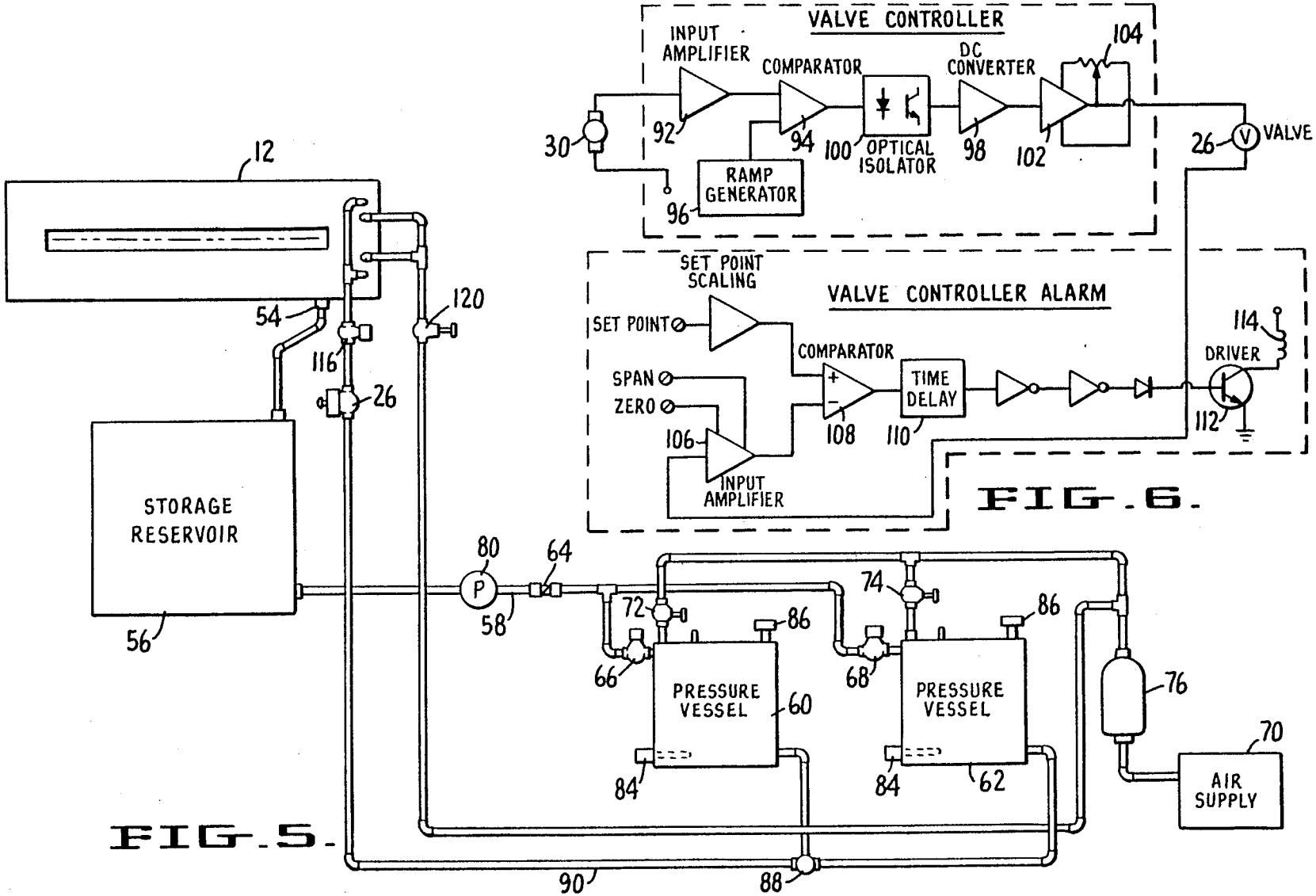
FIG. 5 is a piping diagram illustrating the connections between the coating reservoir and the fluid deposition cabinet.
FIG. 6 is a schematic circuit diagram of the coating weight control system.

The fluid control system for supplying air and coating liquid to the manifold system 20 for the atomizing nozzles is illustrated in greater detail in FIG. 5. The coating liquid is stored in a large capacity, e.g. 250 gallons, storage reservoir 56. A liquid feed line 58 connects an output port of the storage reservoir, through a pump 80, with two pressure vessels 60 and 62 (main and standby) of suitable capacity, e.g. 55 gallons. An oil strainer 64 can be provided in the feed line 58 to remove residue from the liquid tat could clog the nozzles 18. The feed line 58 is selectively connected with the pressure vessels 60 and 62 by means of solenoid controlled valves 66 and 68 to enable the vessels to be filled with a coating liquid from the storage reservoir.

Pressurized air from a suitable supply source 70 is provided to the pressure vessels by means of nullmatic pressure reducing valves 72 and 74 which reduce the pressure to an appropriate value, e.g. 25 psi, before it is supplied to the pressure vessels. When pressurized, either pressure vessel 60 or 62 can be used to dispense the desired coating through a supply line 90 by manually positioning a selector switch on the control unit 28 which actuates a solenoid operated valve 88. The pressurized air that is provided by the supply 70 passes through a condensor/filter 76 to insure a clean, dry air supply.

If the viscosity of the liquid to be coated on the strip is temperature dependent, one or more heaters 84, for example electrical immersion heaters, can be provided in each pressure vessel along with a thermostat or temperature bulb (not shown) to maintain the viscosity of the liquid at the desired value.

Each pressure vessel also includes a liquid level sensor 86, for example a capacitance type sensor. When the sensor in the pressure vessel that is supplying liquid to the depositor cabinet, for example the vessel 60, indicates that the level in that vessel is low, the control unit 28 actuates the pump motor contactor 80 and the solenoid operated valve 66 that connects the input port of the pressure vessel with the feed line 58 from the storage reservoir 56. As the pressure vessel 60 is being filled, displaced air is vented through the pressure reducing valve 72. When the pressure vessel 60 is filled, a liquid level sensor 86 signals the control unit 28 which deenergizes the solenoid operated valve 66 and the pump motor contactor 80. Filling of either pressure vessel is accomplished without interrupting the coating process.

The electrically controlled master regulating valve 26, such as a motor controlled valve, is disposed in the liquid supply line 90. The regulating valve 26 receives a control signal from the control unit 28 to regulate the amount of liquid supplied to the nozzles 18 in the depositor cabinet in accordance with a desired coat weight and the strip line speed. One type of regulating valve that has been found to be particularly well suited for control of the liquid supply rate is a Whitey Regulator Valve, Model No. 5.5-3LRF4. The control signal that is applied to the actuator for the valve can be in the range of 4–20 ma, for example.

A control circuit that receives the output signal of the tachometer/generator 30 and provides the control signal to the regulating valve 26 is illustrated in FIG. 6. The output signal can vary between 0–100 volts, for example, in dependence upon the line speed. This signal is provided to an input amplifier 92, and the amplified signal is fed to a comparator 94 that compares the line speed signal with a reference signal from a ramp generator 96. The pulsed output signal of the comparator, representative of the actual line speed expressed as a percentage of maximum line speed, for example, is provided to a D.C. converter 98 by means of an optical isolator 100. The D.C. converted signal, whose amplitude is dependent upon the duty cycle of the pulsed signal, is presented to an output amplifier 102. The operating bias of the amplifier 102 is adjustable in accordance with the desired set point value of the coat weight by means of a tapped resistor 104. By varying the setting of the movable tap for the resistor 104, the maximum output value of the amplifier 102 is adjusted. The actual output signal of the amplifier is a percentage of this maximum value and is determined by the input signal from the converter 98. This output signal is applied to the actuator for the regulator valve 26 to control the amount of liquid delivered to the nozzles 18.

The control circuit can also include a control failure alarm circuit. A signal from the actuator valve 26 representative of the actual position of the valve can be applied to an input buffer amplifier 106. The amplifier has adjustments for the zero (null) value of the output signal and its span (range). This signal is compared with a scaled value of the set point signal in a comparator 108. If the difference between the feedback signal and the set point signal exceeds a threshold value for a predetermined amount of time established by a time delay circuit 110, a driver circuit 112 is actuated to sound a warning alarm. The driver circuit may be connected to an inductor 114 for a relay that controls an alarm circuit, for example.

Referring again to FIG. 5, the liquid supply line 90 also includes a main solenoid valve 116. This valve is controlled by a signal from the power supply unit 16 so that it is opened, and fluid is supplied to the depositor cabinet 12, only when high voltage power is being provided to the electrodes 14, so that waste of the liquid by spraying in the absence of a corona discharge field is substantially eliminated.

Pressurized air from the air supply 70 is also provided directly to the nozzles 18 by an air feed line 118. The air feed line includes a pressure regulator 120 for reducing the pressure of the air to a suitable value, e.g. 2–5 psi, for assisting the nozzles to atomize the liquid. The atomizing air is continuously supplied to each of the nozzles 18 at all times during the coating operation through the air manifold, rather than being controlled by solenoid operated valves as is the coating liquid. This feature assures that the nozzles will be clean and ready for use. Since each nozzle emits a relatively small amount of air, e.g. less than one cubic foot per minute, the total volume of atomizing air that is used by such an operation is inconsequential. If desired, a valve (not shown) that is controlled in response to line movement can be provided in the feed line 118 to interrupt the flow of pressurized air to the nozzles whenever the strip processing line shuts down.

In addition to the previously described master regulating valve control circuit, the control unit 28 also includes a selector switch for actuating appropriate solenoid control valves for the nozzles to control the width of the liquid spray pattern, as well as choose whether one or both sides of the strip are to be coated. It can also include a line speed meter for indicating the speed of the strip, expressed as a percentage of maximum speed, as measured by the tachometer/generator 30, and a process meter for indicating the percentage of coating applied, to serve as a reference to check linearity of the coating process with the line speed.

The power unit 16 can include an oil filled high voltage transformer comprising a conventional voltage doubler circuit. The output polarity of the transformer is preferably negative, for optimum ionization efficiency. The control panel of the power unit can include a circuit breaker for providing overcurrent protection and on-off control, a transformer output adjustment control, high voltage and primary power indicating lights, a voltmeter and an ammeter.

In operation, the grounded strip enters the depositor cabinet 12 and a corona discharge is established between the high voltage electrodes 14 and the strip 10. The coating liquid is supplied under pressure to the actuated nozzles 18 along with the pressurized atomizing air. The liquid and air are mixed in the nozzles, which causes the liquid to be broken up into small discrete particles having an average size of about 150 microns, for example. Due to the positive pressure created in the nozzles by the liquid and the air, the liquid particles are discharged through the orifices of the nozzles to produce a dense, flat spray that is directed into the corona discharge field at an angle relative to the strip. The density of the spray is controlled by the master regulating valve 26 in accordance with line speed and desired coat weight.

As the liquid particles enter the discharge field they become electrically charged, preferably to a negative potential. Since the strip is at ground potential, the charged particles are attracted to and precipitate onto the strip. Some of the liquid particles may not hold an electrical charge, particularly when a conductive liquid is used for coating. However, the high voltage corona field surrounding the edge of the serrated electrode blade 44 has a tendency to repel particles of matter and deflects the uncharged particles onto the strip as well. When the particles are deposited on the strip they coalesce, and a uniform coverage of the required coating is provided on the strip. The mist that is created by the atomizing nozzles 18 is substantially confined within the depositor cabinet 12 and any unused liquid is collected at the drain 54, to be returned to the reservoir 22, so that waste of the coating material is substantially reduced and environmental conditions are maintained at a higher level.

It will be appreciated from the foregoing description that the present invention offers a number of significant advantages. The uniformity of coverage and reduction in waste enables higher quality functional coatings to be economically applied. The use of a corona discharge field to deflect the atomized liquid, as well as electrostatically charge it, increases the coating efficiency and provides good results with both conductive and on conductive coatings. Unwanted discharge of the coating into the working environment is also diminished.

The present invention can be embodied in other specific forms without departing from the spirit or essential characteristics thereof. For example, it may be desirable to provide separate regulating valves for the upper and lower liquid manifolds with independent set point adjustments so that different coating weights can be applied to the upper and lower surfaces of the steel strip. Other available techniques for supplying the coating material to the nozzles at a suitable pressure, such as gravitY feed or a pump for example, will be apparent.

The presently disclosed embodiment is therefore considered in all respects as illustrative and not restrictive. The scope of the invention is indicated by the appended claims rather than the foregoing description, and all changes that come within the meaning and range of equivalency of the claims are therefore intended to be embraced therein.

What is claimed is:

1. Apparatus for providing a uniform coating of liquid on a continuous moving metal strip, comprising:

means for maintaining the strip at a reference potential;

a linear electrode disposed transverse to and spaced from the strip and maintained at a high voltage to provide a corona discharge field between the strip and the electrode;

an atomizing nozzle connected to a supply of pressurized air and providing a pressurized flat spray of liquid particles directly onto the strip and into said discharge field at an acute angle relative to the strip whereby said particles become electrostatically charged and are deflected toward the strip by the field;

means for supplying coating liquid to said atomizing nozzle under pressure;

means for measuring the speed of said moving strip; and means for controlling the rate at which the coating liquid is supplied to said nozzle in response to the measured strip speed.

2. The apparatus of claim 1 wherein said electrode comprises a rod having a longitudinal slot and a blade disposed in said slot.

3. The apparatus of claim 2 wherein said blade has a serrated edge facing the strip.

4. The apparatus of claim 1 wherein said electrode includes a serrated blade disposed transverse to the direction of movement of the strip.

5. The apparatus of claim 1 wherein said atomizing nozzle is disposed to provide said spray at an angle of about 30° relative to the strip.

6. The apparatus of claim 1, or 5 wherein said nozzle is one of a plurality of nozzles arranged in a series extending in a direction transverse to the direction of movement of the strip.

7. The apparatus of claim 6 including means for controlling the width of the spray pattern produced by said nozzles.

8. The apparatus of claim 7 wherein said width controlling means includes means for selectively actuating said nozzles in accordance with the width of the strip.

9. The apparatus of claim 1 wherein said supplying means includes a pressure vessel and means for supplying pressurized air to said vessel.

10. The apparatus of claim 9 further including a second pressure vessel and means for selectively and alternately connecting said pressure vessels to said atomizing nozzle.

11. The apparatus of claim 10 wherein each of said pressure vessels includes a liquid level sensor and a solenoid operated valve that is actuated in response to a low level signal from said sensor to fill the vessel in which the sensor is located.

12. The apparatus of claim 1 wherein said speed measuring means includes a tachometer/generator, and said controlling means includes an electrically controlled valve that is actuated in response to the output signal from said tachometer/generator.

13. The apparatus of claim 12 further including means for establishing a maximum opening for said valve in accordance with a desired coat weight.

14. The apparatus of claim 1 wherein said electrode and said nozzle are housed within a closed cabinet through which the strip passes in a horizontal direction.

15. Apparatus for providing a uniform coating of liquid on a continuous horizontally moving metal strip, comprising:

means for maintaining the strip at a reference potential;

first and second electrodes respectively disposed above and below said strip and spaced therefrom, said electrodes producing a corona discharge field in the spaces between said electrodes and said strip when they are supplied with a high voltage;

first and second series of atomizing nozzles respectively disposed above and below said strip, said nozzles providing a flat spray of discrete liquid particles directly onto the strip and into said discharge fields at acute angles relative to the strip so that said particles are electrostatically charged and defected toward the strip by said field;

means for separately supplying air and coating liquid to said nozzles under pressure;

means for measuring the speed of the moving strip; and means for controlling the rate at which the coating liquid is supplied to said nozzles in response to the measured strip speed.

16. The apparatus of claim 15 further including means for selectively actuating said nozzles in accordance with the width of the strip.

17. The apparatus of claim 16 wherein said selective actuating means includes solenoid operated valves disposed between said liquid supply means and each of said nozzles.

18. The apparatus of claim 15 further including means for adjusting said controlling means in accordance with a desired coating weight.

19. The apparatus of claim 15 wherein said electrodes and said nozzles are housed within a closed cabinet through which the strip passes.

20. The apparatus of claim 15 wherein said series of nozzles are disposed downstream of said electrodes.

21. The apparatus of claim 15 wherein said controlling means regulates the supply of liquid to said nozzles such that the liquid is applied to the strip at a coating weight in the range of 50–400 mg/ft$^2$.

22. Apparatus for providing a uniform coating of liquid on a continuous horizontally moving metal strip, comprising:

means for maintaining the strip at a reference potential;

first and second electrodes respectively disposed above and below said strip and spaced therefrom, said electrodes producing a corona discharge field in the spaces between said electrodes and said strip when they are supplied with a high voltage;

first and second series of atomizing nozzles respectively disposed above and below said strip, said nozzles providing a flat spray of discrete liquid particles directly onto the strip and into said discharge fields at acute angles relative to the strip so that said particles are electrostatically charged and deflected toward the strip by said field;

means for supplying coating liquid to said nozzles under pressure;

solenoid operated valves disposed between said liquid supply means and each of said nozzles for selectively actuating said nozzles in accordance with the width of the strip;

means for supplying air to said nozzles independently of said valves;

means for measuring the speed of the moving strip; and means for controlling the rate at which the coating liquid is supplied to said nozzles in response to the measured strip speed.

* * * * *